US007018125B2

(12) United States Patent
Su

(10) Patent No.: US 7,018,125 B2
(45) Date of Patent: Mar. 28, 2006

(54) NOTEBOOK HAVING INTEGRAL BINDER MEMBERS

(76) Inventor: Ken Jui Su, No. 180, Su Wang 1st Road, De Li City, Taichung Hsien (TW) 412

( * ) Notice: Subject to any disclaimer, the term of this patent is extended or adjusted under 35 U.S.C. 154(b) by 420 days.

(21) Appl. No.: 10/438,440

(22) Filed: May 14, 2003

(65) Prior Publication Data

US 2004/0228674 A1 Nov. 18, 2004

(51) Int. Cl.
*B42F 13/06* (2006.01)

(52) U.S. Cl. ..... 402/8; 402/60; 402/62; 402/70; 402/73; 402/80 R; 402/80 P; 402/500; 402/502; D19/26; D19/27

(58) Field of Classification Search ..... 402/8, 402/60, 62, 70, 73, 80 R, 80 P, 500, 502; D19/26, 27
See application file for complete search history.

(56) References Cited

U.S. PATENT DOCUMENTS 2,234,401 A * 3/1941 Farkas et al. ..... 402/26
2,297,958 A * 10/1942 Havel ..... 402/8
2,469,166 A * 5/1949 Li Castri ..... 402/80 R
4,174,909 A * 11/1979 Jahn ..... 402/13
5,167,463 A * 12/1992 Corbishley ..... 402/8
5,445,468 A * 8/1995 Pacione ..... 402/75
5,553,959 A 9/1996 Feldman et al. ..... 402/79
5,704,646 A 1/1998 Tzeng ..... 281/29

* cited by examiner

*Primary Examiner*—Boyer D. Ashley
*Assistant Examiner*—Eric A. Gates
(74) *Attorney, Agent, or Firm*—Charles E. Baxley

(57) ABSTRACT

A notebook device includes an intermediate connection member integrally coupled between a top and a bottom cover sheet members with folding lines. The intermediate connection member includes one or more bars and one or more straps coupled between the top and the bottom cover sheet members. The straps include a length greater than that of the bars, to form one or more curved or convex binder members between the top and the bottom cover sheet members. One or more sheet members may be attached to the intermediate connection member and retained between the top and the bottom cover sheet members with the binder member.

10 Claims, 9 Drawing Sheets

NOTEBOOK HAVING INTEGRAL BINDER MEMBERS

BACKGROUND OF THE INVENTION

1. Field of the Invention

The present invention relates to a notebook, and more particularly to a notebook device having integral binder members that are not required to be manufactured separately.

2. Description of the Prior Art

Typical notebooks, organizers, or the like comprise two cover sheets, and a binder device or loose-leaf holder disposed between the two cover sheets, to detachably retain sheet or paper members between the two cover sheets.

For example, U.S. Pat. No. 5,704,646 to Tzeng discloses one of the typical organizers and also comprises a binder device or loose-leaf holder disposed between two cover sheets, to detachably retain sheet or paper members between the cover sheets.

Normally, the binder devices or the loose-leaf holders are made of metal materials, and are required to be manufactured separately and then required to be secured or assembled between two cover sheets, such that the manufacturing cost is greatly increased.

In addition, the binder devices or the loose-leaf holders that are made of metal materials may include a great weight and may also greatly increase the weight of the typical notebooks, organizers, or the like.

U.S. Pat. No. 5,553,959 to Feldman et al. discloses a typical notebook system which comprises a number of disk fastening members to detachably secure or retain two cover sheets and a number of sheet or paper members together. However, the disk fastening members are separately manufactured and are required to be assembled onto the cover sheets and the sheet or paper members, and may be easily disengaged from the cover sheets and the sheet or paper members.

The present invention has arisen to mitigate and/or obviate the afore-described disadvantages of the conventional notebooks or organizers or the like.

SUMMARY OF THE INVENTION

The primary objective of the present invention is to provide a notebook device including integral binder members that are integrally formed between the cover sheets and that are not required to be manufactured separately and that are not required to be further assembled onto the notebook device.

The other objective of the present invention is to provide a notebook device including integral binder members that may be easily and quickly formed between the cover sheets by mass production processes.

In accordance with one aspect of the invention, there is provided a notebook device comprising a top cover sheet member, a bottom cover sheet member, and an intermediate connection member integrally coupled between the top and the bottom cover sheet members with folding lines respectively, for allowing the top and the bottom cover sheet members to be folded relative to the intermediate connection member and to be folded toward each other. The intermediate connection member includes one or more bars coupled between the top and the bottom cover sheet members with the folding lines respectively, and includes one or more straps integrally coupled between the top and the bottom cover sheet members with the folding lines respectively and having a length greater than that of the bars, to form one or more binder members between the top and the bottom cover sheet members.

The binder members and the straps include a length greater than that of the bars and are thus curved and convex relative to the bar of the intermediate connection member.

The intermediate connection member includes one or more lateral cutting lines formed therein to form the straps and one or more second straps between the top and the bottom cover sheet members, and includes a longitudinal cutting line formed in each of the second straps, to form the bars and a second bar in each of the second straps.

The bars of the second straps include a length greater than that of the second bars of the second straps. The second strap includes at least one coupling portion provided between the bar and the second bar in order to secure the bar and the second bar of the second strap together.

The bar of the second strap includes a first segment secured to the second bar of the second strap, and includes a second segment extended beyond the second bar of the second strap, and a reinforcing band secured to the second segment of the bar of the second strap.

One or more sheet members may further be provided and attached to the intermediate connection member and retained between the top and the bottom cover sheet members with the binder member.

Each of the sheet members includes at least one opening and at least one passage formed therein and communicating with each other, to detachably receive the binder member, and to detachably secure the sheet member between the top and the bottom cover sheet members with the binder member.

Each of the openings of the sheet members includes a width greater than a width of the binder member, and includes a depth smaller than the width of the binder member.

Each of the passages of the sheet members includes a width smaller than a width of the binder member, to prevent the binder member from being disengaged from the sheet member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
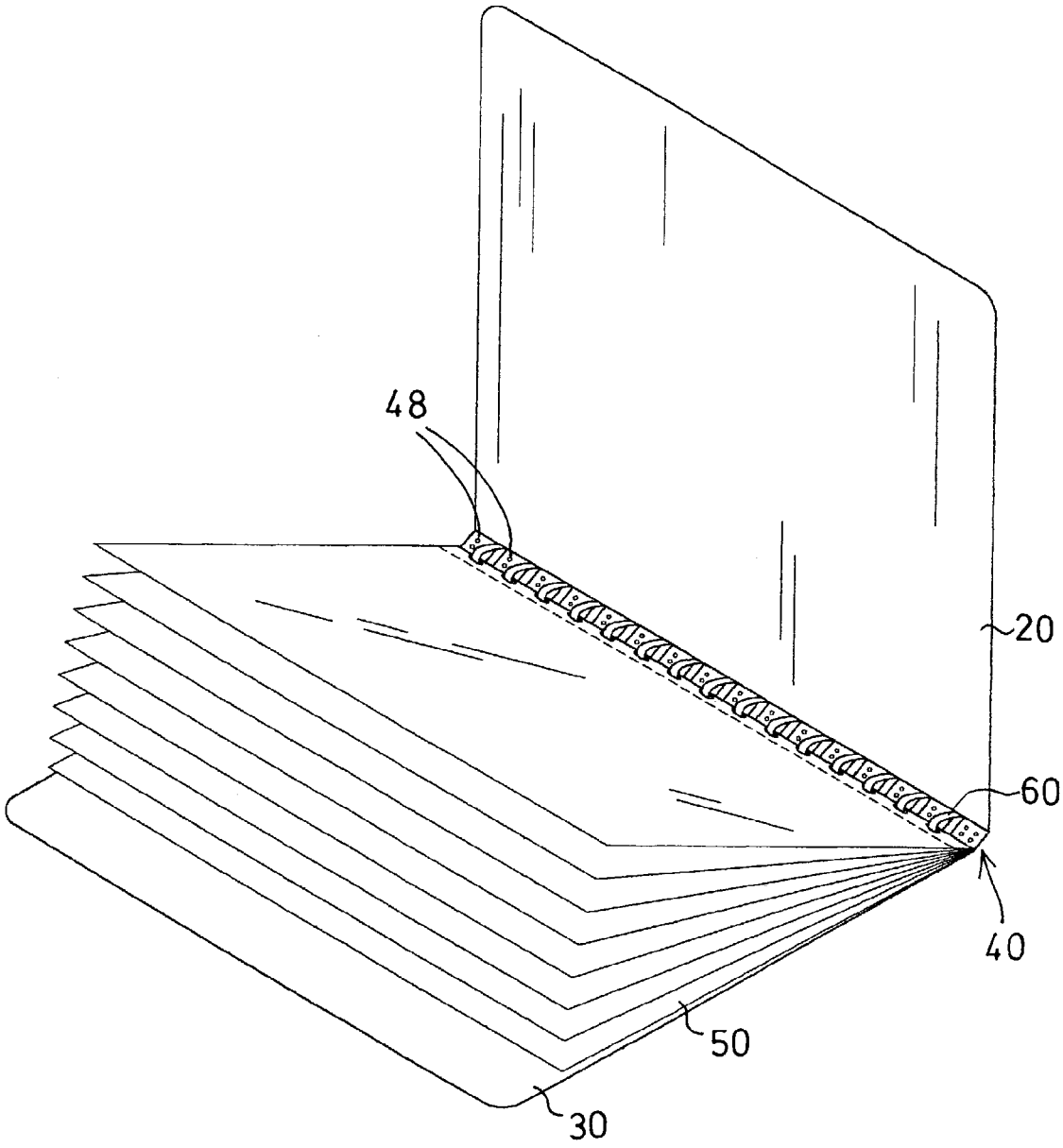
FIG. 1 is a perspective view of a notebook device in accordance with the present invention.
Figure 3:
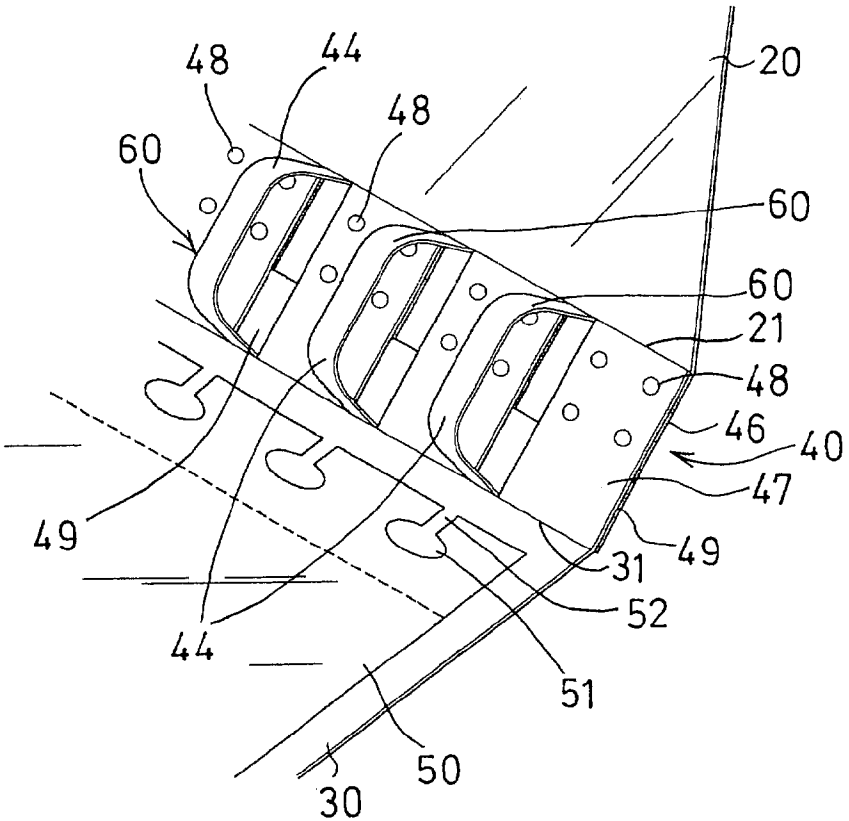
FIG. 3 is a partial perspective view of the notebook device, similar to FIG. 2, in which the sheet member is shown to be disengaged from the binder members of the notebook device.
Figure 2:
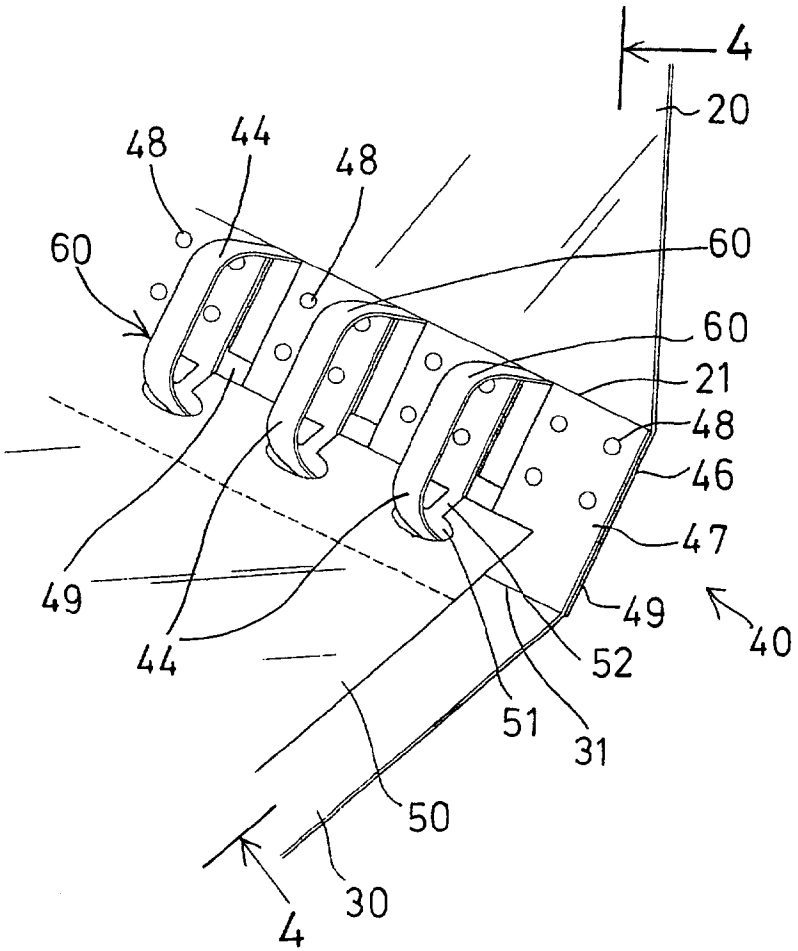
FIG. 2 is a partial perspective view of the notebook device, in which a sheet member is shown to be attached or assembled to the binder members of the notebook device.

Referring to the drawings, and initially to FIGS. 1–3, a notebook device in accordance with the present invention comprises a top cover sheet member 20, a rear or bottom cover sheet member 30, and an intermediate connection member 40 which is integrally formed with and located between the top and the bottom cover sheet members 20, 30.

For example, the intermediate connection member 40 is integrally coupled between the top and the bottom cover sheet members 20, 30 with bending or folding lines 21, 31 respectively (FIGS. 2–7), for allowing the top and the bottom cover sheet members 20, 30 to be folded relative to the intermediate connection member 40 and to be folded toward each other.

One or more binder members 60 are formed or provided on the intermediate connection member 40, and/or integrally coupled between the top and the bottom cover sheet members 20, 30 with the folding lines 21, 31 respectively, which will be described in details hereinafter, in order to retain one or more sheet members 50 within the notebook or between the top and the bottom cover sheet members 20, 30.

As best shown in FIGS. 2 and 3, each of the sheet members 50 includes one or more oval-shaped openings 51 and passages 52 formed therein and communicating with each other, to receive the binder members 60 respectively, and thus to detachably secure the sheet members 50 within the notebook or between the top and the bottom cover sheet members 20, 30 with the binder members 60.

It is preferable that the oval-shaped openings 51 of the sheet members 50 include a width slightly greater than the width of the binder members 60, and a depth slightly smaller than the width of the binder members 60, for retaining the sheet members 50 to the binder members 60, and for allowing the sheet members 50 to be smoothly turned relative to the binder members 60.

The passages 52 of the sheet members 50 include a width smaller than the width of the binder members 60, for prevent the sheet members 50 from being disengaged from the binder members 60. It is to be noted that the sheet members 50 are normally made of paper materials, plastic materials, or the like, and are flexible, such that the binder members 60 may be engaged into the oval-shaped openings 51 of the sheet members 50 via the passages 52 of the sheet members 50 when the sheet members 50 are slightly bent relative to the binder members 60.

As shown in FIGS. 4–7, illustrated is the formation of the formation of the binder members 60 on the intermediate connection member 40 and between the top and the bottom cover sheet members 20, 30.

Figure 5:
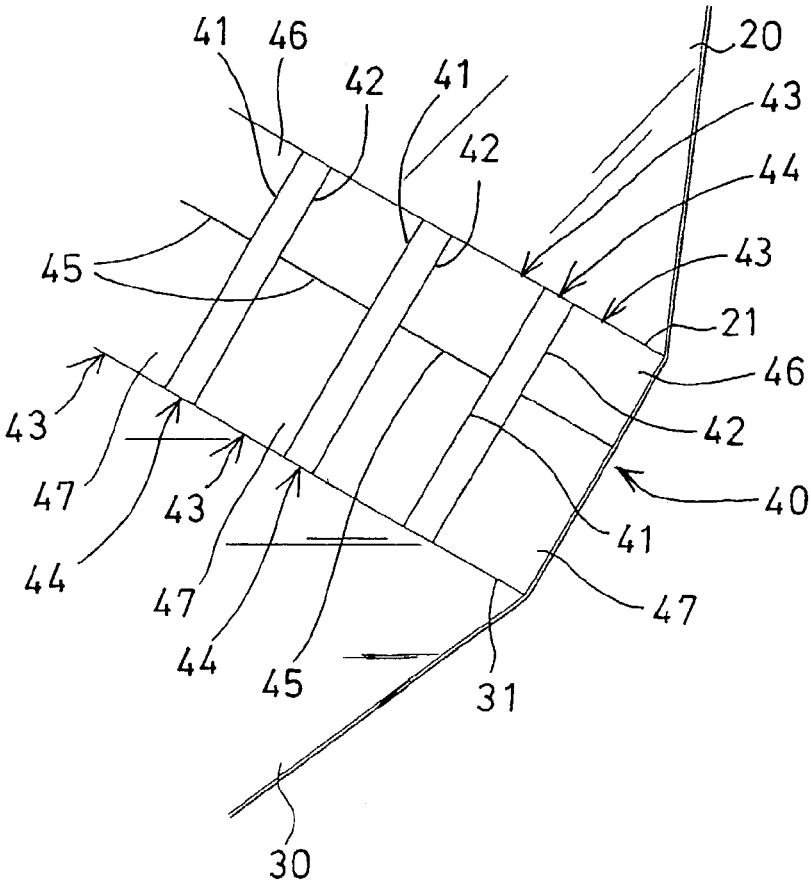
FIGS. 5, 6, 7 are partial perspective views illustrating the manufacturing processes of the notebook device.
Figure 7:
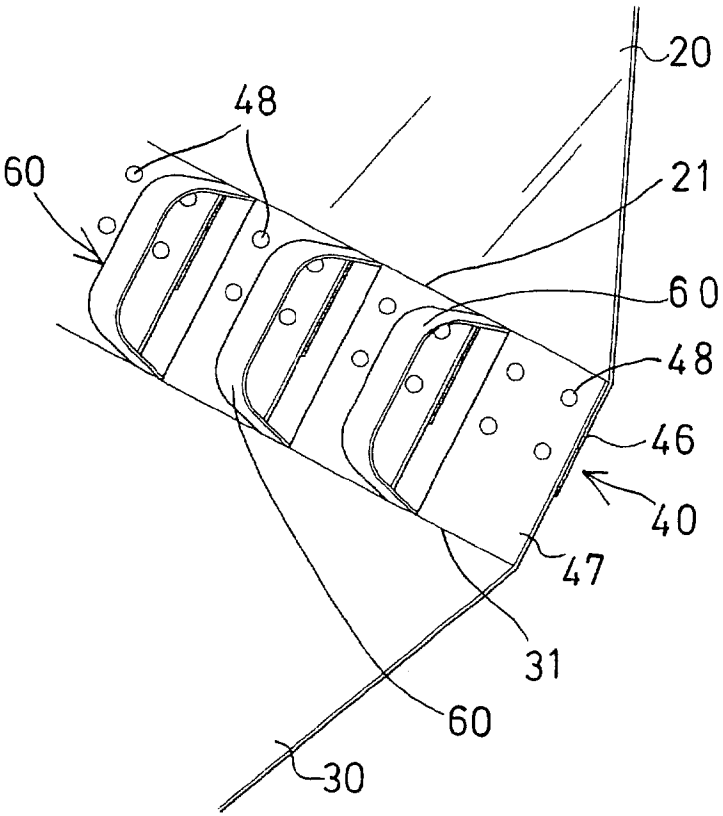
Figure 6:
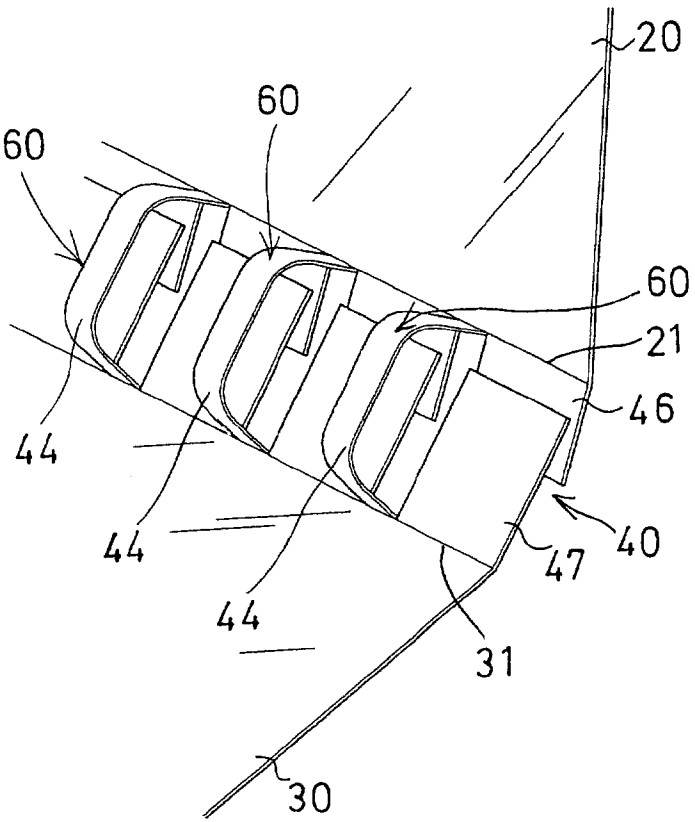
Figure 9:
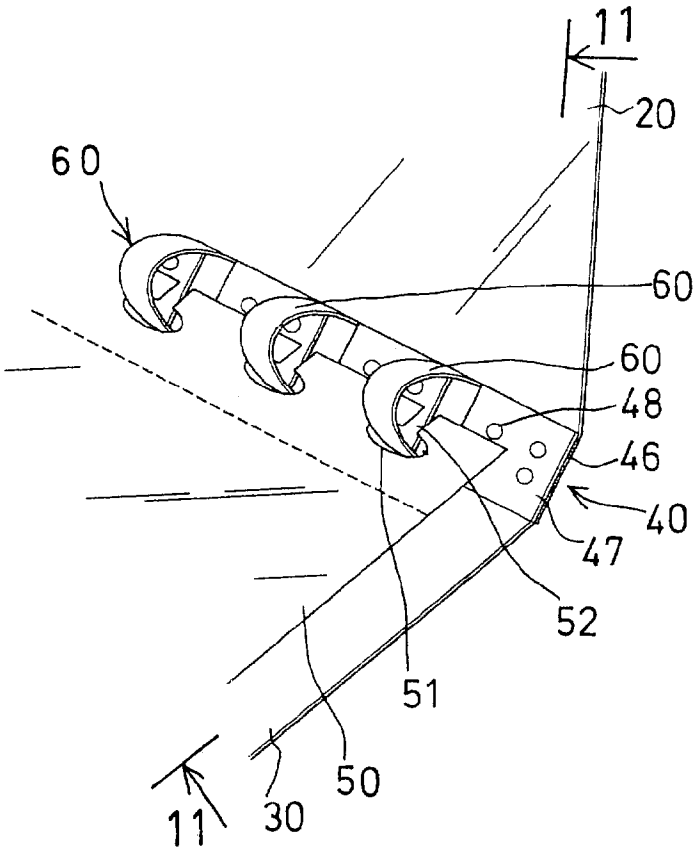
FIG. 9 is a partial perspective view illustrating a further arrangement of the notebook device, in which the sheet member is shown to be attached or assembled to the binder members of the notebook device.

As best shown in FIG. 5, before the binder members 60 are formed, the top and the bottom cover sheet members 20, 30 and the intermediate connection member 40 are formed integrally as a planar sheet member. The intermediate connection member 40 may be formed between the top and the bottom cover sheet members 20, 30 by forming or pressing or scraping the folding lines 21, 31 on the planar sheet member.

The intermediate connection member 40 of the planar sheet member is then cut or formed with one or more transverse or lateral cutting lines 41, 42 in order to form one or more coupling straps 43, 44 in the intermediate connection member 40. The straps 43, 44 of the intermediate connection member 40 are integrally formed and coupled between the top and the bottom cover sheet members 20, 30 with the folding lines 21, 31 respectively, or the top and the bottom cover sheet members 20, 30 may still be coupled together by the straps 43, 44 of the intermediate connection member 40 at this moment.

As best shown in FIG. 5, the straps 44 preferably include a width smaller than that of the other straps 43 as illustrated in the drawing figures. However, the straps 44 may also include a width equals to or greater than that of the other straps 43. The straps 43, 44 are directly formed or cut in the intermediate connection member 40 and formed between the top and the bottom cover sheet members 20, 30, such that the straps 43, 44 include an identical length.

As also shown in FIG. 5, each of the straps 43 further includes a longitudinal cutting line 45 formed therein and preferably parallel to the folding lines 21, 31, in order to cut each strap 43 into two segments or two bars 46, 47, best shown in FIGS. 4–8. The longitudinal cutting line 45 may be formed closer to either of the folding lines 21, 31 (FIGS. 2–8), or equally formed between the folding lines 21, 31 (FIGS. 9–13).

Figure 8:
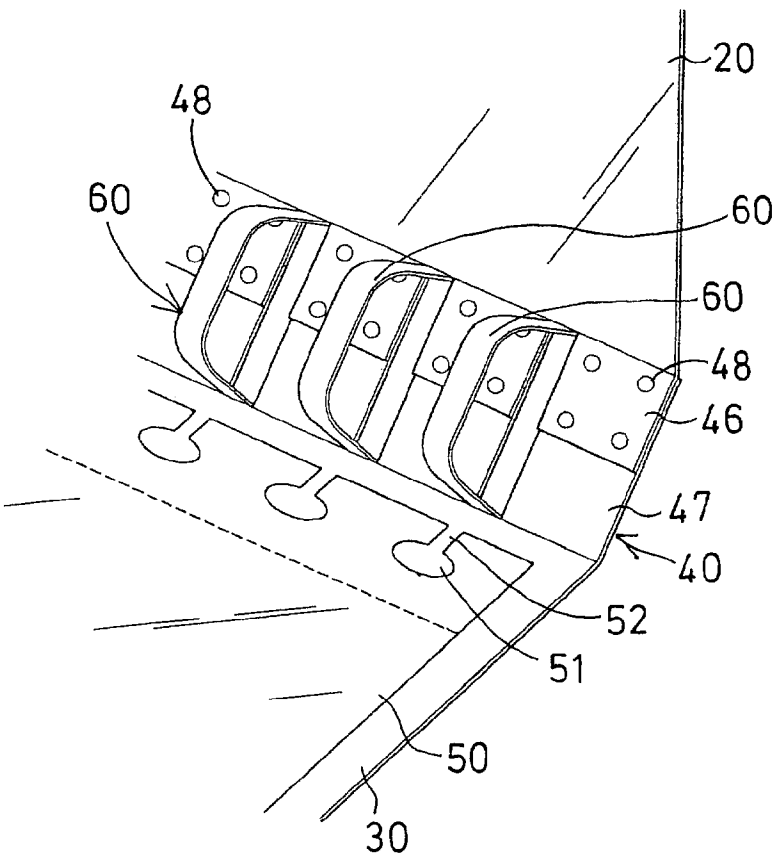
FIG. 8 is a partial perspective view illustrating another arrangement of the notebook device.
Figure 10:
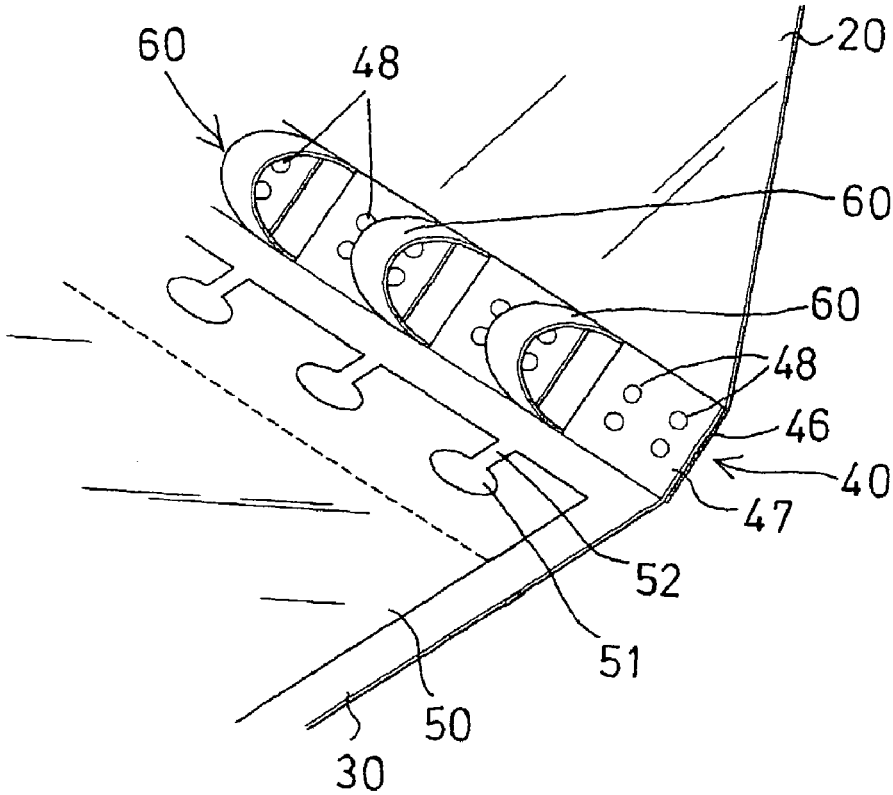
FIG. 10 is a partial perspective view similar to FIG. 9, in which the sheet member is shown to be disengaged from the binder members of the notebook device.

For example, as shown in FIGS. 2–8, the bars 47 include a length greater then that of the other bars 46, and may each include a portion or a segment partially or fully engaged onto and secured to the bars 46 with such as adhesive materials, fasteners, or by welding processes, or other coupling portions 48 (FIG. 7) in order to form the intermediate connection member 40. The bars 47 may either be secured above the bars 46 (FIGS. 2–4 and 7) or below the bar 46 (FIG. 8).

Figure 4:
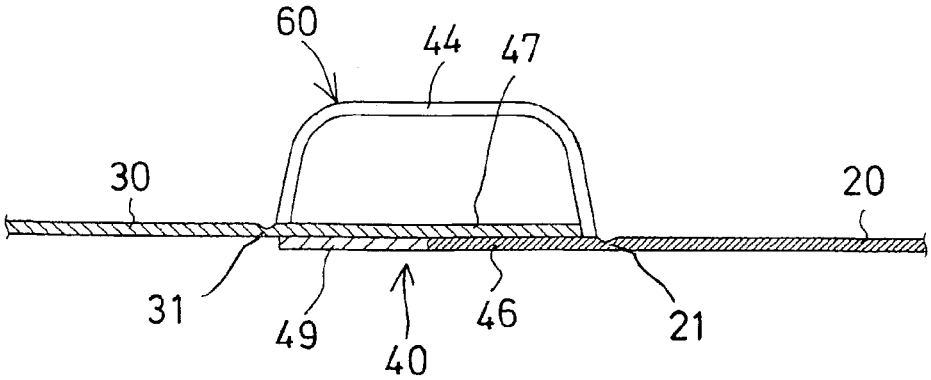
FIG. 4 is a partial cross sectional view taken along lines 4—4 of FIG. 2.

After the straps 43 are cut, and after the bars 47 have a portion secured onto the bars 46, the straps 44 may include a length greater then that of the bars 47, and thus may be curved or convex relative to the intermediate connection member 40, best shown in FIG. 4, in order to form the binder members 60. The binder members 60 may thus be integrally formed between the top and the bottom cover sheet members 20, 30.

It is preferable that the top and the bottom cover sheet members 20, 30 and the intermediate connection member 40 are formed or manufactured from plastic or synthetic materials, for allowing the bars 46, 47 of the straps 43 to be solidly secured together by such as the welding processes, and thus for allowing the binder members 60 to be quickly formed on the intermediate connection member 40 or between the top and the bottom cover sheet members 20, 30 by mass production processes.

Figure 11:
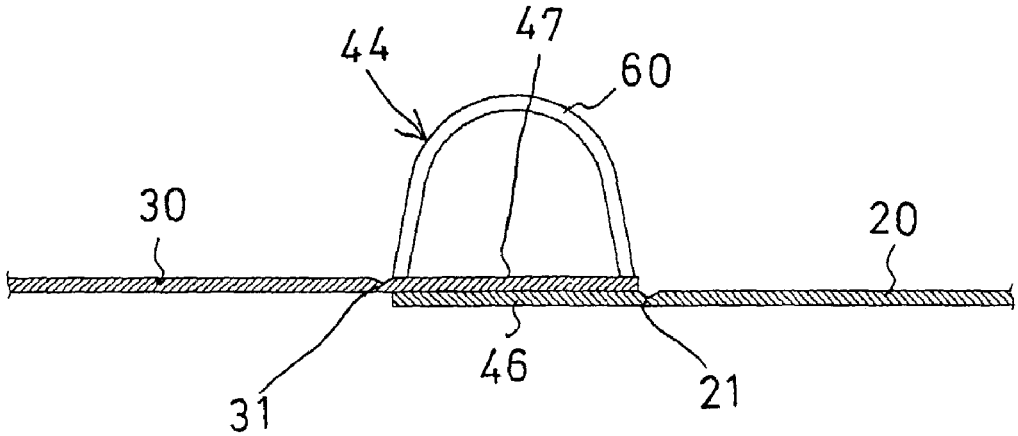
FIG. 11 is a partial cross sectional view taken along lines 11—11 of FIG. 9.
Figure 13:
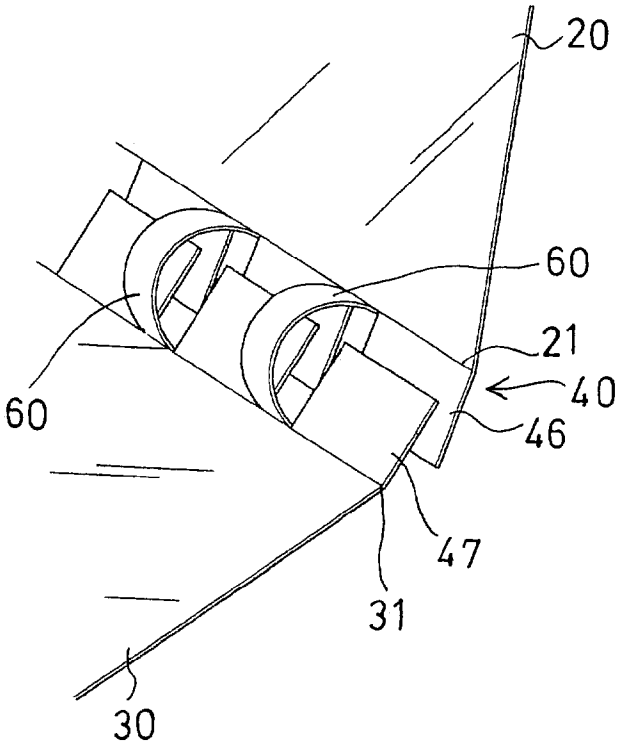
FIGS. 12, 13 are partial perspective views illustrating the manufacturing processes of the notebook device of that shown in FIGS. 9 and 10.
Figure 12:
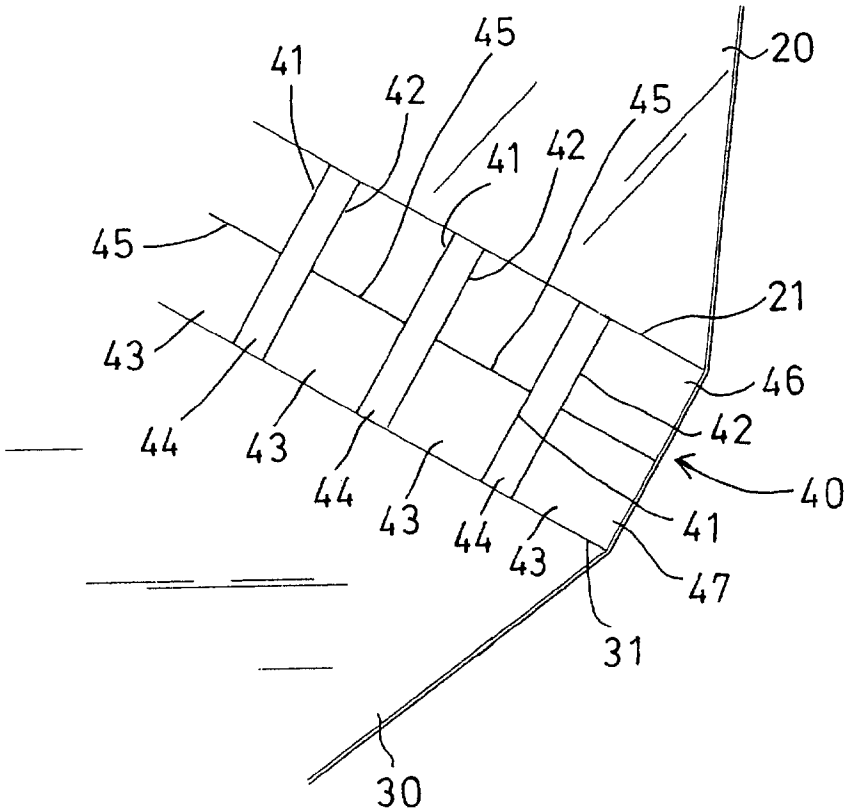
Figure 15:
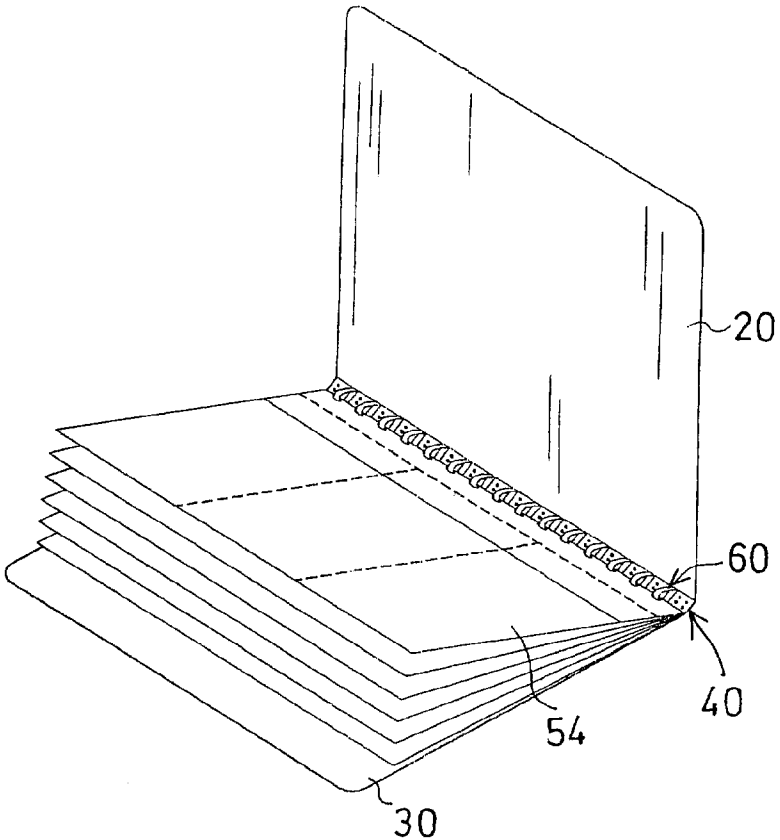
FIGS. 14, 15, 16 are perspective views similar to FIG. 1, illustrating the other arrangements of the notebook device.
Figure 14:
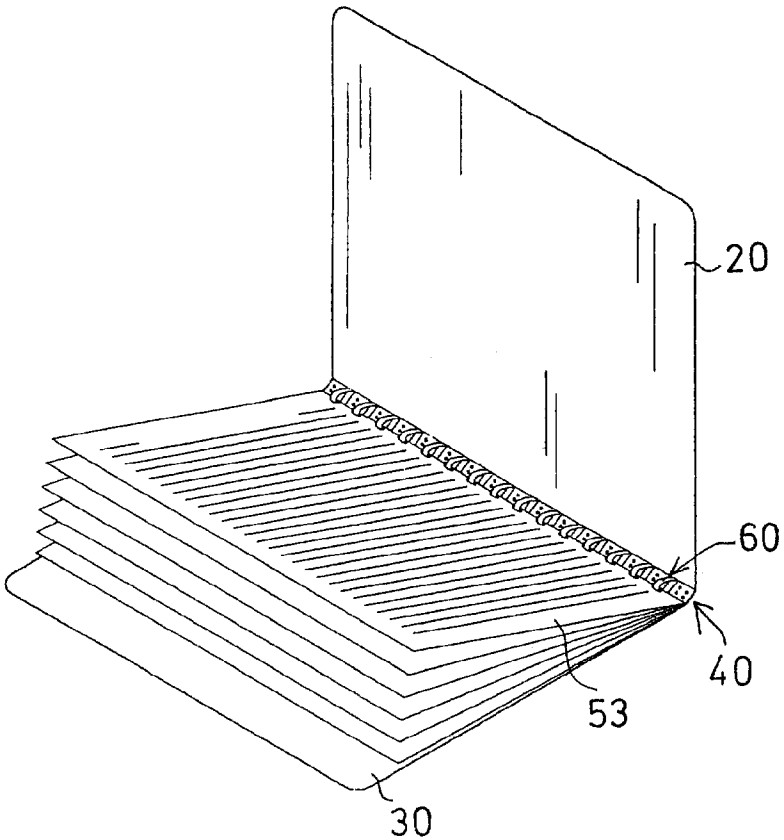
Figure 16:
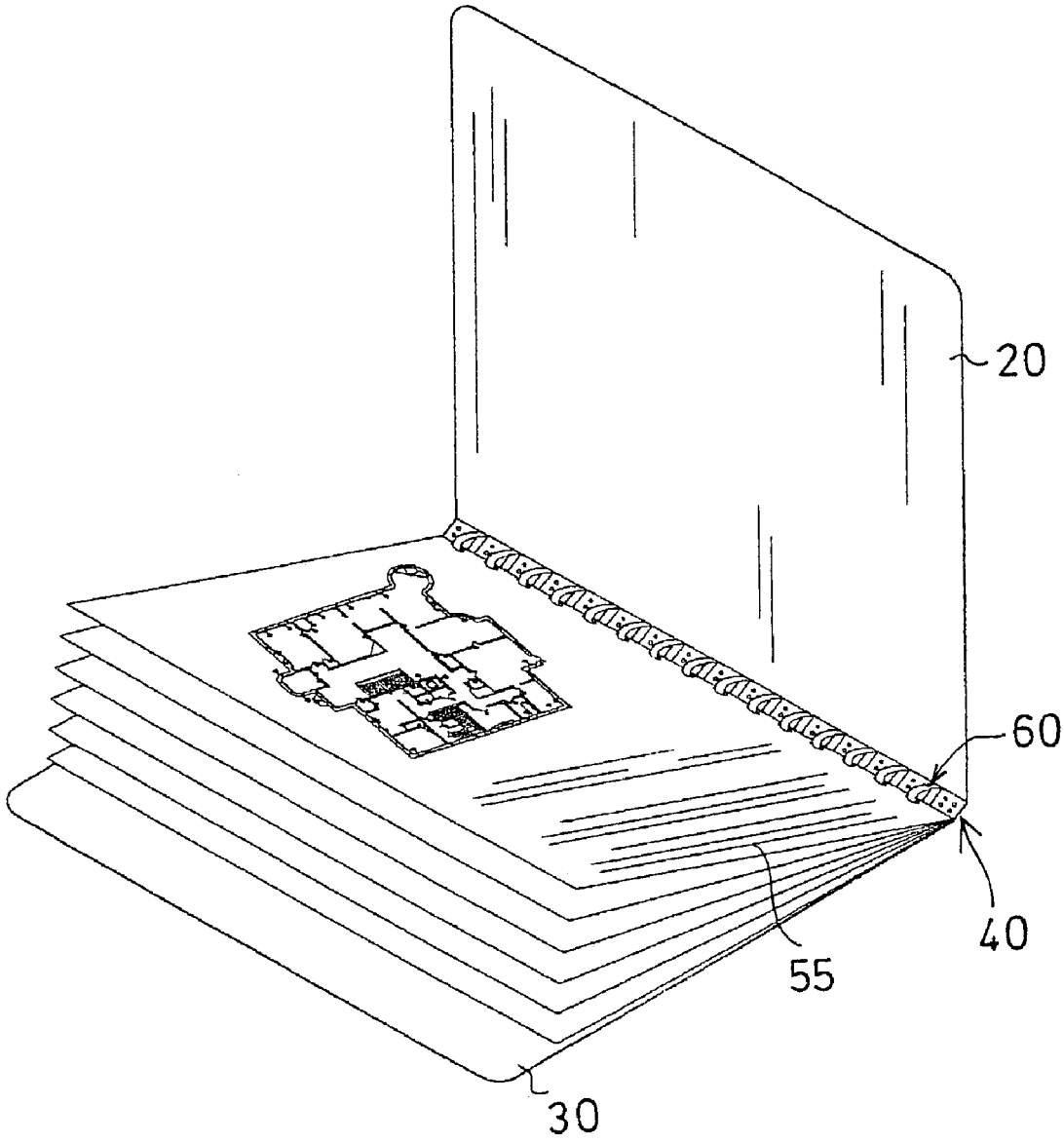

Similarly, as shown in FIGS. 9–13, the bars 46, 47 of the straps 43 may include an identical length, and may be superposed with each other, best shown in FIG. 11. After the straps 43 are cut, and after the bars 47 are secured onto the bars 46, the straps 44 may also include a length greater then that of the bars 46, 47, and thus may also be curved or convex relative to the intermediate connection member 40, in order to form the binder members 60. The binder members 60 may thus also be integrally formed between the top and the bottom cover sheet members 20, 30.

Referring again to FIGS. 2–4, a reinforcing band 49 may further or optionally be provided and secured onto the other portion or other segment of the bars 47 that are not secured onto the bars 46 and that are extended beyond the bars 46 or that are offset from the bars 46, in order to reinforce the bars 46, 47 or the straps 43, or to reinforce the intermediate connection member 40 of the notebook.

In operation, as shown in FIGS. 1, and 14–16, after the binder members 60 are integrally formed on the intermediate connection member 40, and formed between the top and the bottom cover sheet members 20, 30, various kinds of sheet members 50 (FIGS. 1–3 and 8–10), or sheet members 53, 55 (FIGS. 14 and 16), or envelopes 54 for photo albums (FIG. 15) or the like may be detachably secured onto the binder members 60, so as to be detachably retained between the top and the bottom cover sheet members 20, 30.

It is further to be noted that, as best shown in FIGS. 4 and 11, when the top and the bottom cover sheet members 20, 30 are opened to the open position that are parallel to the intermediate connection member 40, the binder members 60 or the straps 44 may still be curved or convex relative to the intermediate connection member 40, such that the sheet members 50 may still be stably retained to the binder members 60 and will not be squeezed by the binder members 60, and thus will not be disengaged from the binder members 60.

Accordingly, the notebook device in accordance with the present invention includes one or more integral binder members that are integrally formed between the cover sheets and that are not required to be manufactured separately and that are not required to be further assembled onto the notebook device, and that may be easily and quickly formed between the cover sheets by mass production processes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A notebook device comprising:

a top cover sheet member, a bottom cover sheet member, and an intermediate connection member integrally coupled between said top and said bottom cover sheet members with folding lines respectively, for allowing said top and said bottom cover sheet members to be folded relative to said intermediate connection member and to be folded toward each other, said intermediate connection member including at least one bar coupled between said top and said bottom cover sheet members with said folding lines respectively, and including at least one strap integrally coupled between said top and said bottom cover sheet members with said folding lines respectively and having a length greater than that of said at least one bar, to form a binder member between said top and said bottom cover sheet members, and said intermediate connection member including at least one lateral cutting line formed therein to form said at least one strap and at least one second strap between said top and said bottom cover sheet members, and including a longitudinal cutting line formed in said at least one second strap, to form said at least one bar and a second bar in said at least one second strap.

2. The notebook device as claimed in claim 1, wherein said binder member and said at least one strap are curved and convex relative to said at least one bar of said intermediate connection member.

3. The notebook device as claimed in claim 1, wherein said at least one bar of said at least one second strap includes a length greater than that of said at least one second bar of said at least one second strap.

4. The notebook device as claimed in claim 1, wherein said at least one second strap includes at least one coupling portion provided between said at least one bar and said at least one second bar in order to secure said at least one bar and said at least one second bar of said at least one second strap together.

5. The notebook device as claimed in claim 1, wherein said at least one bar of said at least one second strap includes a first segment secured to said at least one second bar of said at least one second strap, and includes a second segment extended beyond said at least one second bar of said at least one second strap, and a reinforcing band secured to said second segment of said at least one bar of said at least one second strap.

6. The notebook device as claimed in claim 1 further comprising at least one sheet member attached to said intermediate connection member and retained between said top and said bottom cover sheet members with said binder member.

7. The notebook device as claimed in claim 6, wherein said at least one sheet member includes at least one opening and at least one passage formed therein and communicating with each other, to detachably receive said at least one binder member, and to detachably secure said at least one sheet member between said top and said bottom cover sheet members with said at least one binder member.

8. The notebook device as claimed in claim 7, wherein said at least one opening of said at least one sheet member includes a width greater than a width of said at least one binder member, and includes a depth smaller than the width of said at least one binder member.

9. The notebook device as claimed in claim 7, wherein said at least one passage of said at least one sheet member includes a width smaller than a width of said at least one binder member, to prevent said at least one binder member from being disengaged from said at least one sheet member.

10. The notebook device as claimed in claim 7, wherein said at least one opening of said at least one sheet member includes an oval shape.

* * * * *